US011512514B2

(12) United States Patent
Blum et al.

(10) Patent No.: US 11,512,514 B2
(45) Date of Patent: Nov. 29, 2022

(54) FITTING FOR A FOLDING DOOR

(71) Applicant: Julius Blum GmbH, Hoechst (AT)

(72) Inventors: Lukas Blum, Bregenz (AT); Benjamin Niederer, Lauterach (AT)

(73) Assignee: JULIUS BLUM GMBH, Hoechst (AT)

( * ) Notice: Subject to any disclaimer, the term of this patent is extended or adjusted under 35 U.S.C. 154(b) by 466 days.

(21) Appl. No.: 16/678,099

(22) Filed: Nov. 8, 2019

(65) Prior Publication Data

US 2020/0071980 A1 Mar. 5, 2020

Related U.S. Application Data

(63) Continuation of application No. PCT/AT2018/000042, filed on May 4, 2018.

(30) Foreign Application Priority Data

May 11, 2017 (AT) ..... A 50387/2017

(51) Int. Cl.
*E05D 15/26* (2006.01)
*E06B 3/50* (2006.01)
*E05F 7/00* (2006.01)

(52) U.S. Cl.
CPC ..... *E05D 15/264* (2013.01); *E06B 3/5054* (2013.01); *E05F 7/005* (2013.01); *E05Y 2900/20* (2013.01)

(58) Field of Classification Search
CPC ... E05D 15/264; E05D 11/1064; E05D 15/58; E06B 3/5054; E06B 3/48; E05F 7/005;
(Continued)

(56) References Cited

U.S. PATENT DOCUMENTS 4,945,972 A * 8/1990 Takeuchi ..... E05D 15/264 49/257
5,282,658 A * 2/1994 Reeves, Jr. ..... E05C 17/443 292/338

(Continued)

FOREIGN PATENT DOCUMENTS

CN 1589360 3/2005
CN 1766270 5/2006

(Continued)

OTHER PUBLICATIONS

Chinese Search Report dated Oct. 22, 2020 in counterpart Chinese Patent Application No. 201880040233.0.

(Continued)

*Primary Examiner* — Johnnie A. Shablack
(74) *Attorney, Agent, or Firm* — Wenderoth, Lind & Ponack, LLP

(57) ABSTRACT

A fitting for a folding door arranged on a furniture carcass has at least one first door leaf and a second door leaf connected thereto in a jointed manner. The fitting has a contact part arranged on the first or second door leaf, and the contact part is movably arranged between a contact position and a rest position on the first or second door leaf. In a closed position of the folding door, the contact part in the contact position can be brought into contact with the furniture carcass or a component of the furniture carcass and, in an open position of the folding door, the contact part in the rest position is movable in an intermediate chamber between the first and the second door leaf.

22 Claims, 4 Drawing Sheets

(58) Field of Classification Search
CPC ..... E05F 1/1041; E05F 5/02; E05Y 2900/20; Y10T 16/5383; Y10T 16/53984; Y10T 16/5457
See application file for complete search history.

(56) References Cited

U.S. PATENT DOCUMENTS

| | | | | |
|---|---|---|---|---|
| 7,240,974 | B2 | 7/2007 | Hirtsiefer | |
| 8,707,517 | B2 | 4/2014 | Hofer | |
| 10,316,565 | B2 | 6/2019 | Gabi | |
| 10,753,133 | B2 * | 8/2020 | Kohlweiss | E05F 1/1041 |
| 11,428,034 | B2 * | 8/2022 | Rupp | E05D 15/0665 |
| 2003/0066164 | A1 * | 4/2003 | Domenig | E05D 5/08 16/237 |
| 2004/0239213 | A1 | 12/2004 | Hirtsiefer | |
| 2006/0090295 | A1 | 5/2006 | Hofer | |
| 2015/0008811 | A1 * | 1/2015 | Ishii | E06B 3/5045 312/322 |
| 2017/0247924 | A1 | 8/2017 | Gabi | |
| 2018/0119470 | A1 | 5/2018 | Kohlweiss | |
| 2020/0018108 | A1 * | 1/2020 | Sperger | E05D 15/264 |

FOREIGN PATENT DOCUMENTS

| | | | | |
|---|---|---|---|---|
| DE | 297 10 854 | | 10/1997 | |
| JP | 63-75281 | | 4/1988 | |
| JP | 2-66279 | | 3/1990 | |
| JP | 2002-13341 | | 1/2002 | |
| JP | 2011-162994 | | 8/2011 | |
| JP | 2011162994 | A * | 8/2011 | E06B 3/48 |
| WO | 2016/081960 | | 6/2016 | |
| WO | 2017/000006 | | 1/2017 | |

OTHER PUBLICATIONS

International Search Report dated Aug. 20, 2018 in International (PCT) Application No. PCT/AT2018/000042.
English translation of Search Report dated Nov. 23, 2018 in Taiwanese Application No. 107114853.

* cited by examiner

FITTING FOR A FOLDING DOOR

BACKGROUND OF THE INVENTION

Fittings are already part of the state of the art and the purpose thereof is to allow moveable furniture parts which come into abutment against a furniture carcass to have a defined abutment on the furniture carcass in the closed position. Those moveable furniture parts include doors, folding doors, folding-sliding doors or the like. With the lack of an abutment, the moveable furniture part can be pushed in to an excessive depth for example in the closed position. Furthermore, the moveable furniture part, for example, when in an unstable intermediate state can perform unwanted movements when subjected to a draft or similar influences on the furniture carcass, for example swaying or oscillating. If, in addition, there is a second moveable furniture part beside a first moveable furniture part, a different join gap alignment can occur because of the lack of abutments. Such abutments for moveable furniture parts like folding-sliding doors or sliding doors are usually rigid and are disposed on the rear side of the moveable furniture part. Accordingly, the abutments provided for supporting the moveable furniture part, in the closed position of the latter, are arranged between the moveable furniture part and the furniture carcass and are not visible. If the fitting which is in the form of an abutment is used in relation to a folding-sliding door there is the problem that, in the opened state of the folding-sliding door, the fitting has to find space to be accommodated between the folded-together leaves of the folding-sliding door. In the open position of a folding-sliding door, the two door leaves are oriented in mutually parallel relationship. The abutment must be disposed in the meager space between the door leaves. Accordingly, it is often not possible at all for the door leaves to be moved into a space-saving parallel position, unless the door leaves are moved sufficiently far away from each other in the open position, whereby once again this does not permit the article of furniture to be of a compact structure. In addition, there is the problem that the gap between the folding-sliding door or folding door and the furniture carcass in the closed position is often greater than the spacing between the individual door leaves in the parallel position thereof. Accordingly, in the closed position a larger gap in respect of the folding door or folding-sliding door and the furniture carcass has to be bridged over by the abutment on the folding door or folding-sliding door while in the parallel position or the open position of the folding or folding-sliding door that abutment would be in the way as the spacing of the two door leaves in the parallel position is substantially less than the required length of the abutment.

SUMMARY OF THE INVENTION

The object of the invention is to avoid the above-described disadvantages and to provide a fitting which is improved over the state of the art.

In addition, a folding door can have a fitting according to the invention, and an article of furniture can have such a folding door.

If the contact portion is arranged on the first or second door leaf moveably between a contact position and a rest position, wherein in a closed position of the folding door, the contact portion in the contact position can be brought into contact with the furniture carcass or a component of the furniture carcass, and in an open position of the folding door, the contact portion is moveable in a rest position into an intermediate space between the first and second door leaves, this provides a flexible abutment which in the open position of the folding door is disposed in space-saving fashion in the limited space between the folding doors, and in the closed position of the folding door acts in supporting relationship between the folding door and the furniture carcass or a part of the furniture carcass. The folding door is thus supported in the closed position. If a second folding door is arranged on the furniture carcass, then an acceptable gap configuration is maintained between the two folding doors. Therefore, a folding door cannot sink or pivot more deeply into the furniture carcass than the other one as both folding doors are supported by the fitting on the furniture carcass in the same fashion. That is also achieved by the abutment being adjustable in length in order to be able to bridge over tolerances which possibly occur at the different door leaves or folding doors. In general, it is to be stated that the term folding door is also used to include a folding-sliding door.

It has been found to be particularly advantageous in that respect that the contact portion for the movement between the contact position and the rest position is pivotably mounted hingedly about an axis of rotation on the first or second door leaf or on a base body fastened to the first or second door leaf. Assembling the fitting to one of the door leaves is considerably facilitated by the base body. The contact portion being mounted pivotably about the axis of rotation provides a space-saving fitting which in the parallel position of the door leaves, that corresponds to the open position of the folding door, takes up little space between the door leaves.

If the contact portion is moveable from the rest position into the contact position by a force storage member, then the pivotal movement between the rest position and the contact position takes place automatically upon the movement of the folding door between the closed position and the open position. That therefore provides that the contact portion is pushed or pulled for example into the contact position by the force storage member. The force storage member is overcome by a counteracting force in the displacement of the folding door into the closed position, whereby the contact portion is moved into the rest position. That is also effected by the force storage member being arranged between the contact portion and the base body or the first or second door leaf. The force storage member can be formed, for example, by a gas spring, an elastomer or preferably by a spring, particularly preferably a tension spring. In other words, the force storage member is provided by a spring, preferably a tension spring.

If the contact portion is mounted pivotably between the rest position and the contact position through between 0° and 90°, preferably 0° and 80°, particularly preferably 0° and 75°, that gives a contact portion which can be disposed in space-saving relationship between the door leaves.

If the contact portion, at a free end, has a contact part which can be brought into contact with the furniture carcass or a component of the furniture carcass, the contact support region of the contact portion is defined thereby. The contact part can, for example, have a plurality of properties. It can be, for example, of a damping configuration in order to minimize the generation of noise. In addition, it can be mounted in the form of a rotatable rolling body at the free end of the contact portion and the rolling body can be brought into contact with its peripheral surface with the furniture carcass or a component thereof. Thus, upon closure of the door leaves a rolling movement at the rolling body is generated thereby, which reduces noise and minimizes wear. If that rolling body is produced, for example, from a plastic then it additionally performs noise-reducing effects. Furthermore, by virtue of a suitably softer material on the contact part this arrangement prevents the furniture carcass being damaged at the contact region of the contact part.

It has been found to be advantageous if the contact part of the contact portion in the contact position projects further from the door leaf to which it is fixed than in the rest position. That provides that the generally larger gap between the door leaves and the furniture carcass is bridged over and the smaller gap between the two door leaves in the parallel position is compensated by the moveable contact portion.

It has additionally proven to be advantageous if the contact portion is adjustable in its length by way of an adjustment portion. In that way, for example, tolerances on the furniture carcass and/or the door leaves can be compensated by the adjustment portion.

If, for example, a plurality of door leaves or folding doors are installed on a furniture carcass, they can be adjusted in their position relative to the furniture carcass and in their position relative to each other. This, therefore, provides a uniform gap alignment between the furniture parts and the furniture carcass. In addition, by virtue of the adjustability the fitting can be used in a number of areas and not just on articles of furniture which are specifically tailored for that.

If the adjustment portion is formed by a slot and the length of the contact portion can be arrested by at least one arresting member—preferably in the form of a screw—and a corresponding fixing portion—preferably in the form of a counterpart thread—, that affords a simple possible option for adjustment. It is possible to carry out the adjustment with commercially usual tools. The configuration in the form of a slot makes it clear to the user that this involves an adjustment portion. Thus, when fitting the abutment, the attention of the user is drawn to the fact that he is capable of adjusting the spacing of the contact portion relative to the door leaf.

If the fitting is of a two-part structure, wherein an abutment portion is arranged on the first door leaf and a guide portion is arranged on the second door leaf, the counteracting force against the force storage member can be applied by the abutment portion. Upon displacement of the door leaves from the open position into the closed position, that abutment portion presses against the force storage member and moves the contact portion from the contact position into the rest position. In other words, it is advantageous that the contact portion arranged on the abutment portion, upon displacement of the door leaves between the open position and the closed position, is moved by the guide portion from the contact position into the rest position. That takes place against the force of the force storage member.

If the guide portion includes a ramp, along which the contact portion, preferably the contact part of the contact portion, is displaceable, that provides a simple guide portion which is arranged in space-saving relationship between the two door leaves. In that case, the ramp produces a necessary counteracting force for bridging over the force storage member and thus for displacement of the contact portion into the rest position. The ramp generates a noise-reduced displacement of the contact portion along the guide portion. It is advantageous in that respect if the ramp is made for example from a noise-damping plastic.

It has further proven to be advantageous if the ramp is of a curved configuration as a convex curve relative to the door leaf. That convex curvature provides that the ramp can be of a still more compact configuration and can thereby more easily find space in the limited space between the door leaves. The convex curvature additionally assists upon displacement of the contact portion against the force storage member.

If upon pivotal movement of the folding door with the at least one door leaf and the second door leaf hingedly connected thereto into the open position, the fitting is folded together and upon unfolding into the closed position the fitting is opened up with subsequent abutment against the furniture carcass, that provides that good positioning of the folding door is guaranteed in the closed position while in the open position the fitting is disposed in space-saving relationship between the two door leaves.

It has proven to be particularly advantageous in that respect that upon pivotal movement of the folding door with the at least one first door leaf and the second door leaf hingedly connected thereto into the open position, the fitting is folded together and the door leaves are arranged in substantially mutually parallel relationship, wherein the folding door or folding-sliding door in the open position can be inserted into a retraction compartment on the furniture carcass. In that way, it is possible for the overall arrangement of the door leaves to be stowed in a retraction compartment beside the furniture carcass. Accordingly, the door leaves are not disposed in the room in the open position. That gives a visually clean appearance even in the open position. The folding door is stowed in the opened state. The retraction compartment can be narrower by virtue of the fitting which can be folded together, and that is a further advantage of the invention.

BRIEF DESCRIPTION OF THE DRAWINGS

Further details and advantages of the present invention are described more fully hereinafter by means of the specific description with reference to the embodiments by way of example illustrated in the drawings in which.

DETAILED DESCRIPTION OF THE INVENTION

Figure 1:
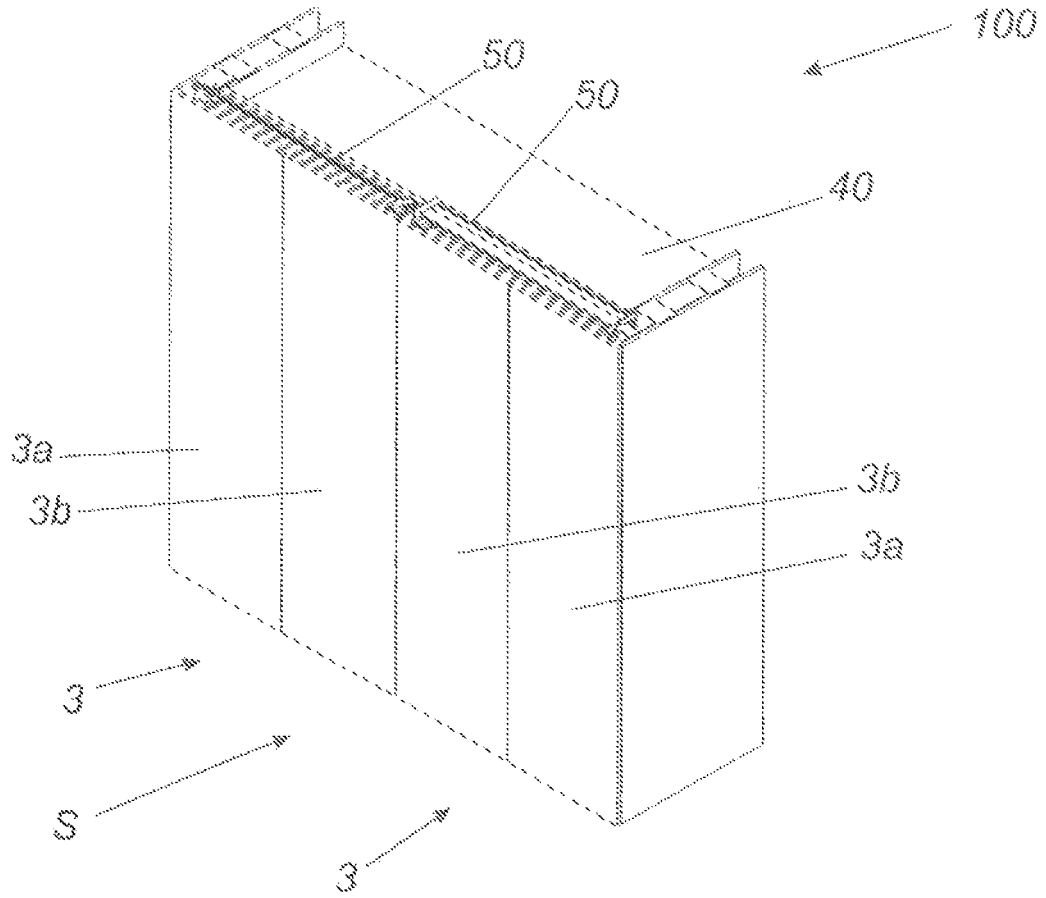
FIG. 1 is a perspective view of an article of furniture with folding doors in the closed position.

FIG. 1 shows an article of furniture 100 with a furniture carcass 40, in which there are fitted at least one folding door 3, comprising a first door leaf 3*a* and a second door leaf 3*b*. The door leaves 3*a*, 3*b* are mounted moveably along a guide 50. FIG. 1 shows the closed position S in which the at least one folding door 3 is closed and thus the door leaves 3*a*, 3*b* are in a coplanar position.

Figure 2:
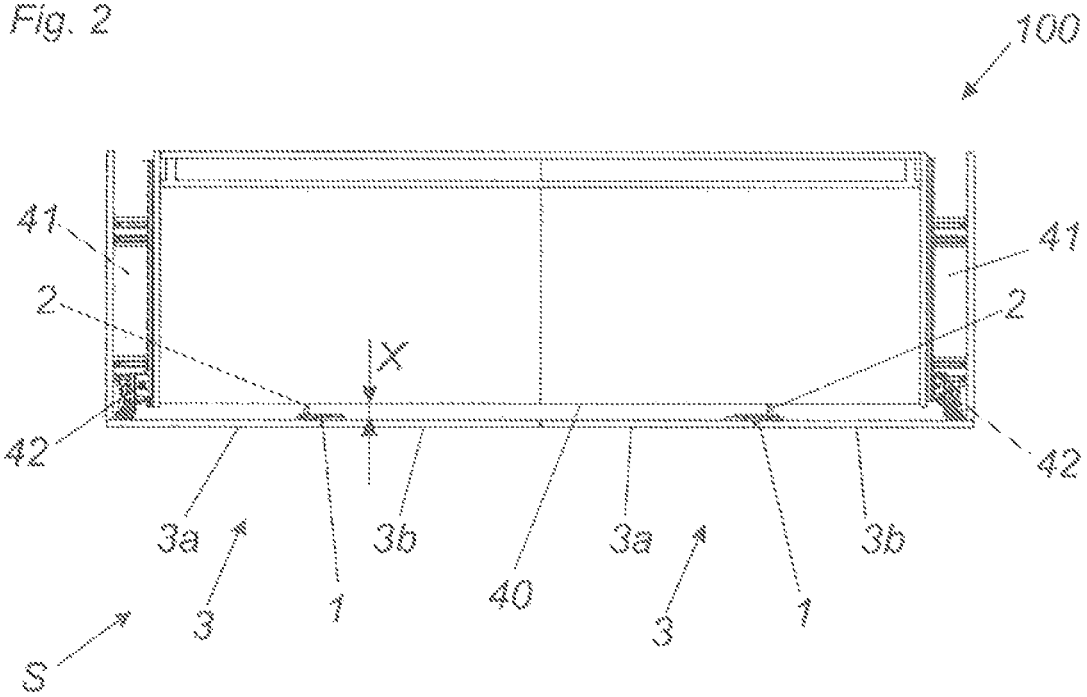
FIG. 2 is a plan view of an article of furniture with folding doors in the closed position.

FIG. 2 shows a plan view of the article of furniture 100. At least one retraction compartment 41 is arranged laterally on the article of furniture 100 or on the furniture carcass 40. The compartment 41 serves to receive the folding door 3 when moved into the open position O. The term folding doors 3 is also used to denote a folding-sliding door as that is not only folded but can also be displaced along the guides 50 shown in FIG. 1. Disposed in the region between the furniture carcass 40 and the at least one folding door 3 is at least one fitting 1 having a contact portion 2. In the closed position S of the at least one folding door 3, the contact portion 2 of the fitting 1 contacts a component of the furniture carcass 40 or the furniture carcass 40 itself. This, therefore, ensures that the folding door 3 is positioned relative to the furniture carcass 40 in the closed position S. The gap configuration between the individual door leaves 3*a*, 3*b* and/or the folding doors 3 is thus correctly set. It can be seen that the gap X between the folding door 3 and the furniture carcass 40 is bridged over by the fitting 1. In the closed position S of the folding door 3, the contact portion 2 in the contact position K can be brought operatively in a non-yielding relationship against the furniture carcass 40 or a component of the furniture carcass 40. In an open position O of the folding door 3, the contact portion 2 is moveable in a rest position R yieldingly into an intermediate space Z between the first and second door leaves 3*a*, 3*b*. Positioning of the folding doors 3 is therefore implemented not just by the folding hinges 42 but also by the fitting 1. For the sake of simplification, the guides 50 in the upper region of the article of furniture 100 have been omitted from the drawing in FIG. 2. Besides the fittings 1 at the gap between the door leaves 3*a*, 3*b*, there is also an unfolding aid which is triggered upon over-pressing of the door leaves 3*a*, 3*b* and supports opening pivotal movement of the folding doors 3 from the closed position S in the direction of the open position O. Therefore, the contact portion 2 must also be slightly yielding in order to be able to compensate for that over-pressing effect. That is effected, for example, by a force storage means arranged in or at the fitting 1. Upon over-pressing out of the coplanar position into an over-pressing position of the folding door 3, the contact portion 2 on the fitting 1 can thus slightly yield in order to be able to ensure triggering of the ejection aids. The ejection aids are not visible in FIG. 2, they are disposed in a region above or below the fitting 1 at the door gap between the door leaves 3*a*, 3*b*.

Figure 3:
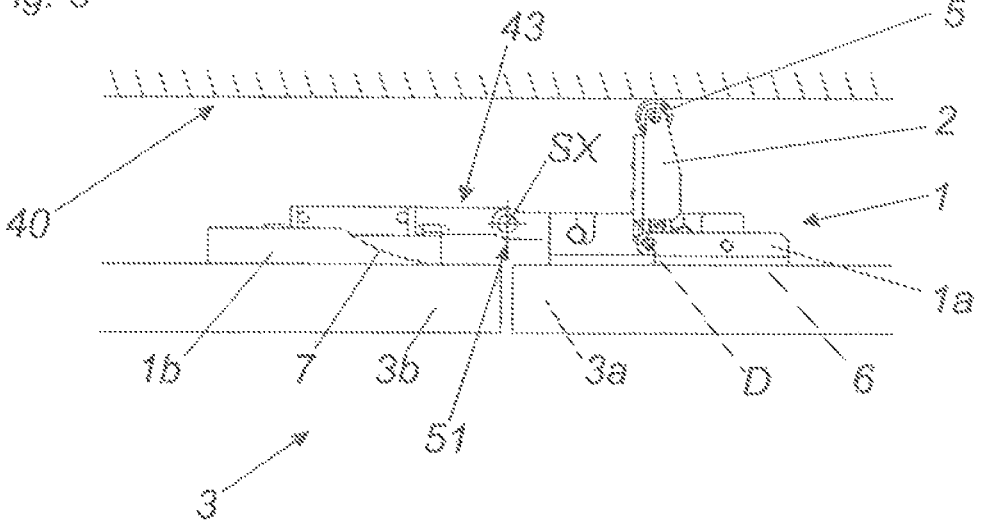
FIG. 3 shows a fitting in the contact position.

FIG. 3 shows the door leaves 3*a*, 3*b* in the closed position S. The door leaves 3*a*, 3*b* are connected together by a hinge 43 having a hinge axis SX. The hinge 43 can also include the ejection aid which is extended in FIG. 2 in order to promote opening of the door leaves 3*a*, 3*b* from the closed position S into the open position O. That ejection aid, however, can also be implemented by an independent component which is disposed along the door gap between the door leaves 3*a*, 3*b*. Besides the hinge 43, there is the fitting 1 having an abutment portion 1*a* on the door leaf 3*a*. Disposed on the door leaf 3*b* is the corresponding guide portion 1*b* of the fitting 1, which can be brought into contact with the abutment portion 1*a* and which cooperates with the contact portion 2 in a certain position of the door leaves 3*a*, 3*b*. FIG. 3 shows the closed position S, the contact portion 2 is supported with the contact part 5 by a part of the furniture carcass 40 (i.e., is brought into contact with an element of the furniture carcass 40) and thus serves as an abutment. In that arrangement, the contact portion 2 is mounted rotatably or pivotably about an axis of rotation D to the base body 6 of the fitting 1. The cooperation between the guide portion 1*b* and the abutment portion 1*a* or the contact part 5 of the contact portion 2 is effected by way of a ramp 7. That ramp 7 is in one piece with the guide portion 1*b*.

Figure 4:
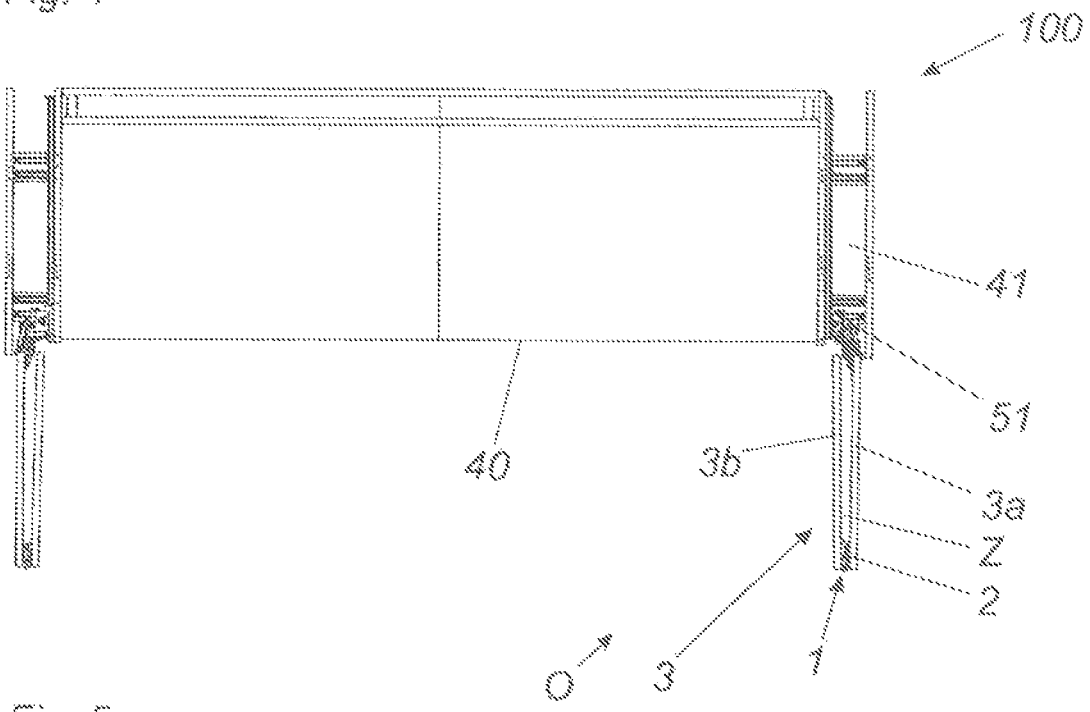
FIG. 4 shows an article of furniture in the open position.

FIG. 4 shows the article of furniture 100 in the open position O, wherein the fitting 1 with its contact portion 2 is disposed in the folded-together state in the intermediate region Z between the door leaves 3*a*, 3*b*. The door leaves 3*a*, 3*b* which are almost parallel or substantially parallel do not allow such a large spacing relative to each other that the fitting 1 can retain its dimensioning, as shown in FIG. 2. The fitting 1 must be yielding in order to be able to move the door leaves 3*a*, 3*b* into the open position O in order to be able subsequently to position the door leaves 3*a*, 3*b* for example in the retraction compartment 41. FIG. 4 thus shows the rest position of the fitting 1. By virtue of a guide 50, the arrangement of the door leaves 3*a*, 3*b* can be introduced in the open position O into the retraction compartment 41. The article of furniture 100 is thus opened forwardly, with the retraction compartment 41 being occupied by the folding door 3.

Figure 5:
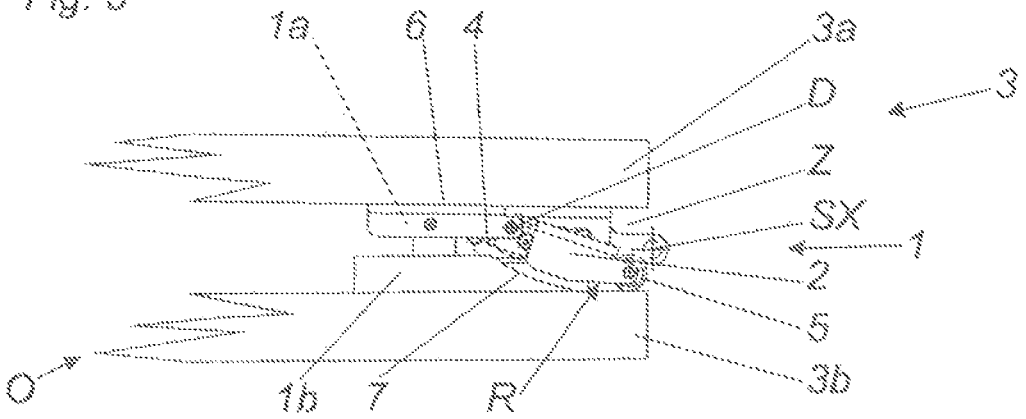
FIG. 5 shows a fitting in the rest position.

FIG. 5 shows how the door leaves 3*a*, 3*b* of the folding door 3 have been pivoted relative to each other and are in the open position O. The pivotal movement is effected by way of the pivot axis SX. In that case, the contact part 5 of the contact portion 2 is displaced along the ramp 7 of the guide portion 1*b* into the rest position R. That movement takes place against a force storage member 4. The force storage member 4 is disposed between the abutment portion 1*a* and the contact portion 2 and assists with a return movement of the contact portion 2 out of the rest position R into the contact position K. Instead of a force storage member 4, it would also be possible for example to use the force of gravity to promote positioning of the contact portion 2 in the contact position K. The ramp 7 would have to act against the force of gravity in order to move the contact portion 2 into the rest position R. In the preferred embodiment as shown in FIG. 5, however, the contact portion 2 is displaced about the axis of rotation D against the ramp 7 by the force storage member 4.

Figure 6:
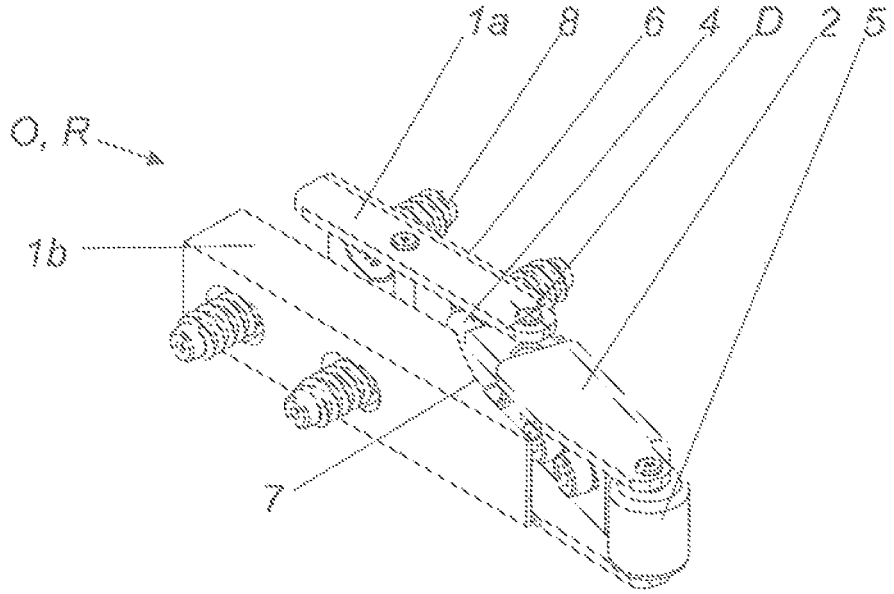
FIG. 6 shows a fitting in the open position of the folding door.

FIG. 6 shows the fitting 1 for simplification purposes without the door leaves 3*a*, 3*b*. In this case, the fitting 1 is in the rest position R. That corresponds to the open position O of the door leaves 3*a*, 3*b* (not shown). The components forming the fitting 1, comprising the abutment portion 1*a* and the guide portion 1*b*, are connected to the door leaves 3*a*, 3*b* by a fixing member 8. The force storage member 4, which is in the form of a tension spring, is under tension in the rest position and endeavors to retract the contact portion 2, together with the contact part 5, into the contact position K (see FIG. 7). By virtue of the fact that the door leaves 3*a*, 3*b*, however, are in the open position, that movement cannot take place and is blocked. It is only when the door leaves 3*a*, 3*b* are moved into the closed position S that the force storage member 4 can pull or move the contact portion 2 together with the contact part 5 into the contact position K. It will also be seen from FIG. 6 that the contact portion 2 is fitted rotatably about an axis of rotation D, consisting of a pin or a screw, on the base body 6. The contact part 5 is in the form of a rolling body which is disposed rotatably at the free end of the contact portion 2 and with the periphery of which the contact with the component of the furniture carcass 40, that is not visible in FIG. 6, can be made. The ramp 7 is adapted to the geometry of the contact part 5. This means that the contact part 5 in the form of the rolling body can move along the ramp 7. In that case, the ramp 7 which is convexly curved relative to the door leaf 3*b* facilitates the movement of the contact portion 2 out of the rest position R into the contact position K and vice-versa.

Figure 7:
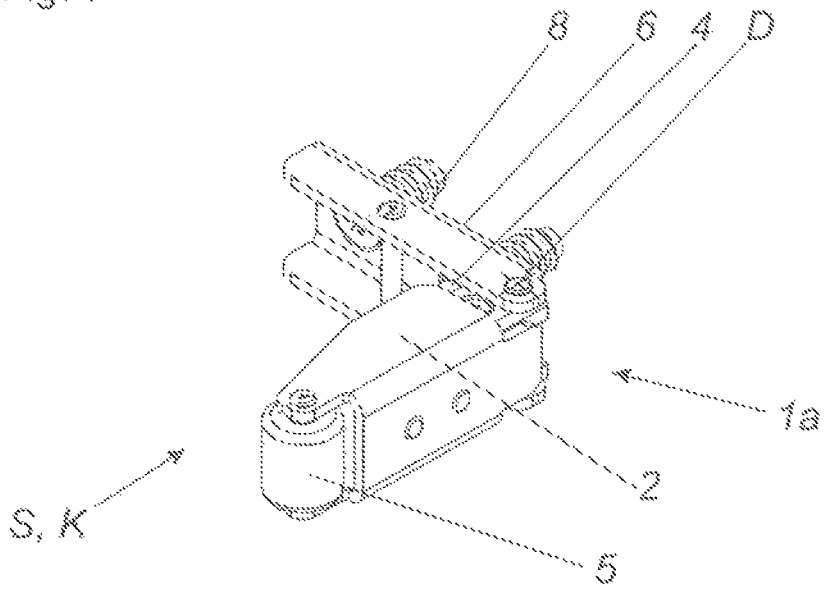
FIG. 7 shows a fitting in the closed position of the folding door.

FIG. 7 shows the fitting 1 in the contact position K corresponding to the closed position S of the door leaves 3*a*, 3*b*. Here too, the door leaves 3*a*, 3*b* have been removed from the drawing for the purposes of simplicity. The force storage member 4 has thus pulled or moved the contact portion 2 into the contact position K.

Figure 8:
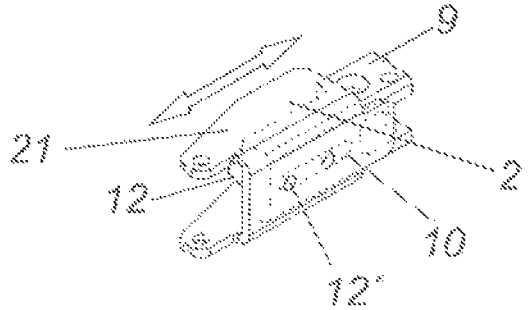
FIG. 8 shows the adjustability of the fitting.

FIG. 8 shows that the contact portion 2 comprises two elements which are moveable relative to each other. In that arrangement, the contact portion 2 has a carrier portion 9 which can be connected to the base body 6 rotatably via the axis of rotation D (see FIG. 7). The carrier portion 9, in this case, has an adjustment portion 10, along which the displacement portion of the contact portion 2 is longitudinally moveably mounted. The adjustment portion 10 is in the form of a slot extending along the carrier portion 9. The adjustment portion 21 is fixed in its position relative to the carrier portion 9 by at least one arresting member 12 or a corresponding fixing portion 12'. The mounting member for the contact part 5 is also disposed on the adjustment portion 21. In this case, there are also apertures for receiving a rotary pin or fault, to which the rolling body forming the contact part 5 is fitted. For simplification purposes, the contact part 5 has not been shown in FIG. 8. The relative position between the folding door 3 and the furniture carcass 40 can be adjusted by the adjustment portion 10.

Figure 9:
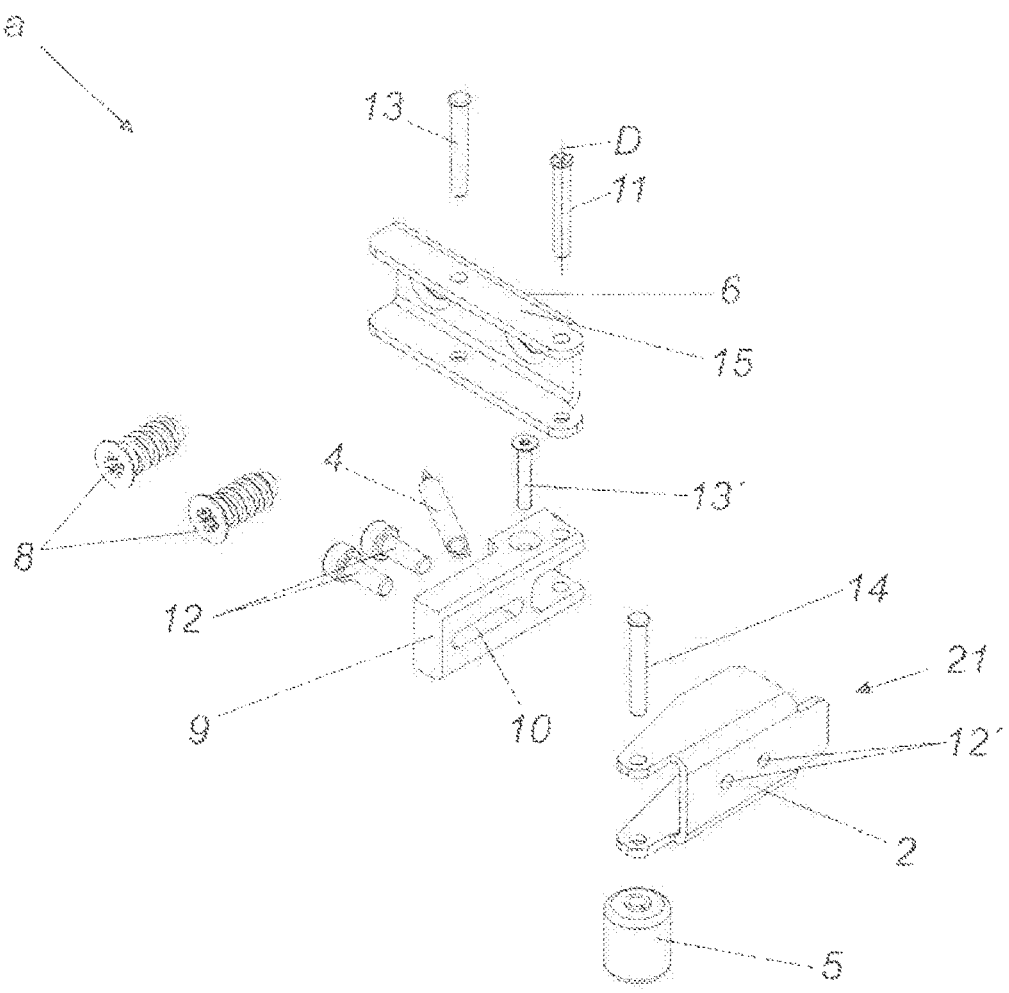
FIG. 9 is an exploded view illustrating components of the fitting.

FIG. 9 shows an exploded view of the abutment portion 1*a* of the fitting 1. It comprises the base body 6, the fixing member 8 with which the base body 6 can be fixed to a door leaf 3*a*, 3*b*. The base body 6 further has the receiving member for the axis of rotation D, in the form of a rotary pin 11. The carrier portion 9 is subsequently moveably mounted thereto. The force storage member 4 is fixed between the base body 6 and the carrier portion 9. That is effected by way of the attachment member 13 and 13'. They can be in the form of pins, screws or bolts. The contact part 5 is fitted to the adjustment portion 21 of the contact portion 2 by way of a further attachment member 14. The arresting member 12 with the corresponding fixing portion 12' arranged in the adjustment portion 21 are in the form of screws with a corresponding counterpart thread. It is also possible here to use only one screw with a corresponding counterpart thread. Instead of a tension spring providing the force storage member 4, it would also be possible to use an elastomer, a pneumatic or a hydraulic damper or something comparable, which causes the return movement of the contact portion 2.

Figure 10:
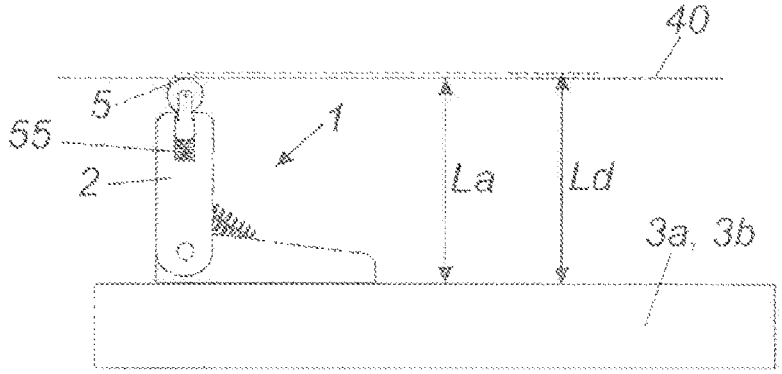
FIG. 10 shows a variant with a damping device.

FIG. 10 shows a diagrammatic view of a contact portion 2 having a damping device 55. The damping device 55 provides for damping upon contact of the contact portion 2 and the furniture carcass 40 or a part of the furniture carcass 40 like for example a worktop, a base panel, a shelf or a cover panel. The damping device 55 can be provided by a spring, a hydraulic or pneumatic damper or an elastic element, the spring force or the return force of which is less than the closing force of the door leaves 3*a*, 3*b* moving them into the closed position S. The damping device 55 thus has no influence on the spacing La between the door leaves 3*a*, 3*b* and the furniture carcass 40 as the damping device 55 is completely pushed through in the closed position of the door leaves 3*a*, 3*b*. The damping device 55 supports the contact part 5 which is shown in FIG. 10 in the form of a roller and which is carried on a spring plunger. Instead of a roller, it is also possible to provide a simple, spring-mounted pin or a simple elastic element on the contact portion 2. In the closed position S, the overall length Ld of the contact portion 2 changes into the spacing La which corresponds to the gap X between the furniture carcass 40 and the folding door 3 (see FIG. 2) as the entire damping device 55 is over-pressed by the closing force. In spite of the damping device 55 non-yielding, hard firm abutment of the contact portion 2 against the furniture carcass 40 or a part thereof is achieved, whereby the relevant spacing La is exactly established in that way.

The invention claimed is:

1. An article of furniture comprising:

a furniture carcass;

a folding door arranged on the furniture carcass, the folding door including a first door leaf and a second door leaf hingedly connected to the first door leaf; and a fitting mounted on the folding door, the fitting including a contact portion arranged at one of the first door leaf or the second door leaf so as to be moveable between a contact position and a rest position, wherein the fitting is configured such that, in a closed position of the folding door, the contact portion in the contact position contacts an element of the furniture carcass, and in an open position of the folding door, the contact portion in the rest position is in an intermediate space between the first door leaf and the second door leaf, and wherein the fitting is configured such that the contact portion extends in a perpendicular direction relative to the one of the first door leaf or the second door leaf in the contact position.

2. The article of furniture according to claim 1, wherein the fitting further comprises a base body mounted to one of the first door leaf or the second door leaf, the contact portion being pivotably mounted hingedly about an axis of rotation on the base body to allow movement between the contact position and the rest position.

3. The article of furniture according to claim 1, wherein the fitting is configured such that, upon pivotal movement of the folding door into the open position, the fitting is folded together, and upon pivotal movement and unfolding of the folding door into the closed position, the fitting is opened up with subsequent abutment of the contact portion against the element of the furniture carcass.

4. The article of furniture according to claim 1, wherein the fitting is configured such that, upon pivotal movement of the folding door into the open position, the fitting is folded together and the door leaves are arranged in a substantially mutually parallel relationship, and the folding door in the open position can be inserted into a retraction compartment on the furniture carcass.

5. The article of furniture according to claim 1, wherein the contact portion in the contact position establishes a spacing between the folding door and the furniture carcass at a fixed value defined by a length of the contact portion.

6. The article of furniture according to claim 1, wherein the contact portion is moveable from the rest position into the contact position by a force storage member.

7. The article of furniture according to claim 6, wherein the fitting further comprises a base body, the force storage member being arranged between the contact portion and the base body or between the contact portion and the one of the first door leaf or the second door leaf.

8. The article of furniture according to claim 6, wherein the force storage member is a spring.

9. The article of furniture according to claim 1, wherein the contact portion is mounted pivotably so as to pivot between the rest position and the contact position through an angle of between 0° and 90°.

10. The article of furniture according to claim 9, wherein the contact portion is mounted pivotably so as to pivot between the rest position and the contact position through an angle of between 0° and 75°.

11. The article of furniture according to claim 1, wherein the contact portion has a free end with a contact part to be brought into contact with the element of the furniture carcass.

12. The article of furniture according to claim 11, wherein the contact part of the contact portion in the contact position projects further from the one of the first door leaf or the second door leaf than in the rest position.

13. The article of furniture according to claim 11, wherein the contact part is a rotatable rolling body mounted at the free end of the contact portion, and the rolling body has a peripheral surface to be brought into contact with the element of the furniture carcass in the contact position.

14. The article of furniture according to claim 1, wherein a length of the contact portion is adjustable by an adjustment portion.

15. The article of furniture according to claim 14, wherein the adjustment portion is a slot, and the fitting portion further includes an arresting member and a corresponding fixing portion for arresting a length of the contact portion.

16. The article of furniture according to claim 15, wherein the arresting member is a screw, and the corresponding fixing portion is a counterpart thread.

17. The article of furniture according to claim 1, wherein the fitting further includes an abutment portion arranged on the first door leaf and a guide portion arranged on the second door leaf.

18. The article of furniture according to claim 17, wherein the contact portion is arranged on the abutment portion and is moveable from the contact position into the rest position by a displacement of the first door leaf and the second door leaf between the open position and the closed position by the guide portion.

19. The article of furniture according to claim 17, wherein the guide portion includes a ramp along which the contact portion is displaceable.

20. The article of furniture according to claim 19, wherein the ramp has a curved configuration in the form of a curving convex relationship with the door leaf.

21. An article of furniture comprising:

a furniture carcass;

a folding door arranged on the furniture carcass, the folding door including a first door leaf and a second door leaf hingedly connected to the first door leaf; and a fitting mounted on the folding door, the fitting including a contact portion arranged at the first door leaf or second door leaf so as to be moveable between a contact position and a rest position, wherein the fitting is configured such that, in a closed position of the folding door, the contact portion in the contact position is brought into contact with an element of the furniture carcass, and in an open position of the folding door, the contact portion in the rest position is moved into an intermediate space between the first door leaf and the second door leaf, and wherein the fitting further includes an adjustment portion for adjusting a length of the contact portion.

22. A fitting comprising:

a base body to be mounted to a first door leaf of a folding door such that a longitudinal axis of the base body is parallel to a plane of the first door leaf;

an abutment portion mounted on the base body;

a guide portion pivotably connected to the abutment portion, the guide portion to be mounted to a second door leaf of the folding door; and a contact portion pivotably connected to the base body and the abutment portion so as to be pivotable between a contact position and a rest position, wherein the fitting is configured such that, in a closed position of the folding door, the contact portion is in the contact position and extends in a perpendicular direction relative to the longitudinal axis of the base body, and in an open position of the folding door, the contact portion is in the rest position and located in an intermediate space between the abutment portion and the guide portion, and wherein the contact portion extends in a perpendicular direction relative to the longitudinal axis of the base body in the contact position.

* * * * *